United States Patent [19]

Donnelly et al.

[11] Patent Number: 4,712,771

[45] Date of Patent: Dec. 15, 1987

[54] WALLBOARD JACK

[76] Inventors: Kevin S. Donnelly, 5842 Comanche Dr., San Jose, Calif. 95123; Ralph H. Donnelly, 425 Hershner Dr., Los Gatos, Calif. 95030

[21] Appl. No.: 854,020

[22] Filed: Apr. 21, 1986

[51] Int. Cl.[4] ..... B66F 3/00

[52] U.S. Cl. ..... 254/131

[58] Field of Search ..... 254/131, 120, 8 R

[56] References Cited

U.S. PATENT DOCUMENTS

| | | | |
|---|---|---|---|
| 671,554 | 4/1901 | Heisler | 254/120 |
| 1,018,282 | 2/1912 | Warner | 254/120 |
| 2,692,753 | 10/1954 | Masterson | 254/131 |
| 2,904,309 | 9/1959 | Mayville | 254/131 |
| 2,989,286 | 6/1961 | Gillespie | 254/131 |

FOREIGN PATENT DOCUMENTS

| | | | |
|---|---|---|---|
| 106198 | 4/1927 | Austria | 254/120 |

*Primary Examiner*—Robert C. Watson
*Attorney, Agent, or Firm*—Gerald L. Moore

[57] ABSTRACT

A jack for raising and holding articles such as wallboard, comprising a base [15] with a pivotally attached lever assembly [16] mounted on the base in a manner that downward pressure on one end will raise the other end. Releasable ratchet means [35] is connected for holding the lever in the raised position.

1 Claim, 5 Drawing Figures

FIG. 4
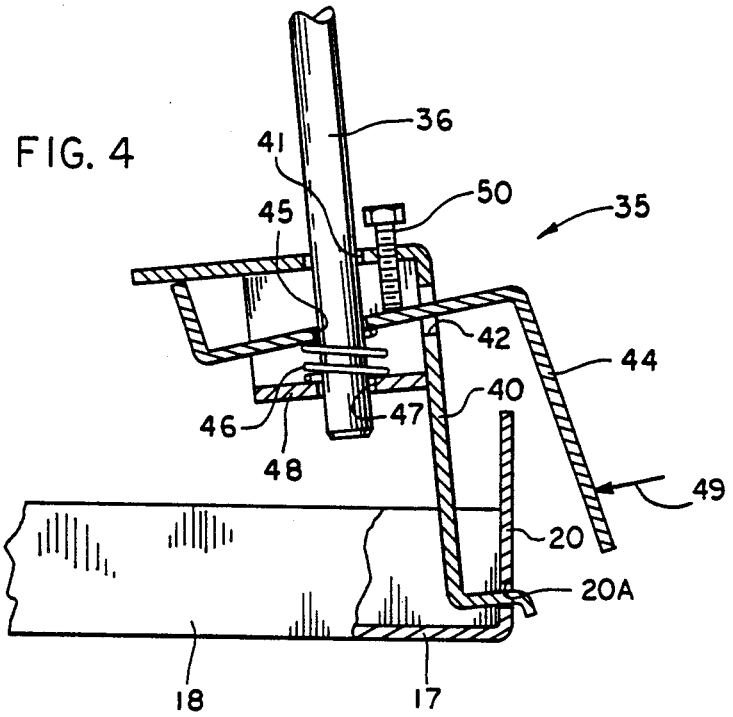
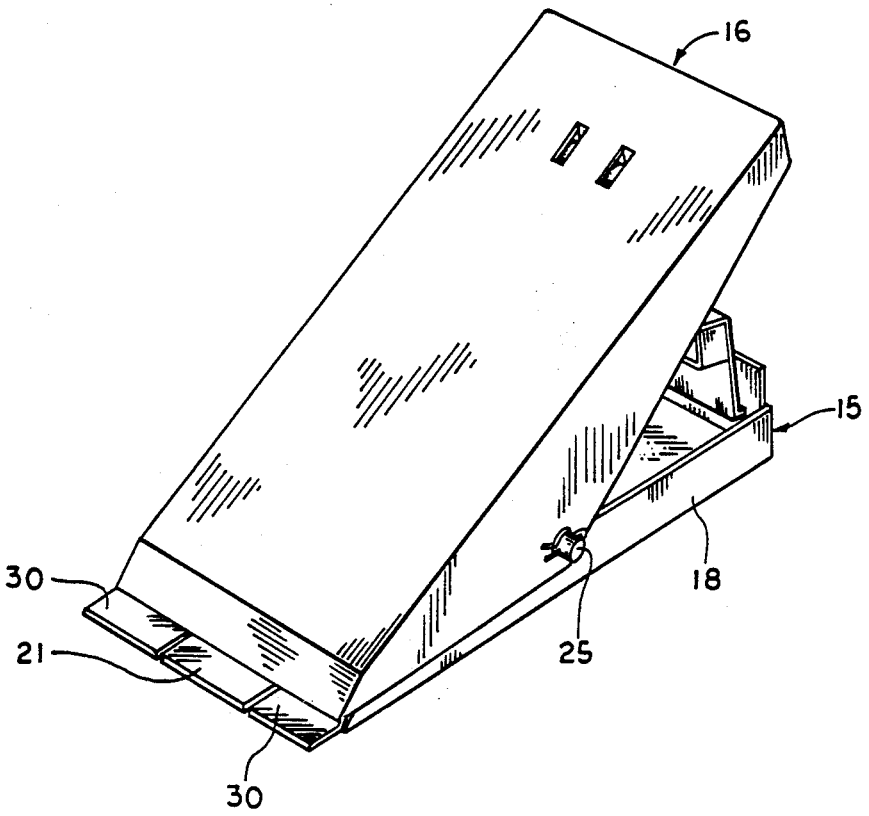
FIG. 1

WALLBOARD JACK

FIELD OF THE INVENTION

This invention relates to a foot operated jack primarily used for lifting and holding wallboard in an elevated position so that it can be nailed properly.

BACKGROUND OF THE INVENTION

Wallboard such as sheet rock or paneling is usually nailed onto the wall studs or onto an existing wall. In order to properly position the wallboard it must be lifted upward into abutting relationship with the next adjacent sheet. For instance, if the wallboards are installed one above the other, the lower board must be elevated to a position tightly against the upper board so that the seam can be properly dressed. When installing the wallboard in the stand-up position the wallboard must be lifted until it abuts the ceiling so that the juncture between the board and the ceiling can be dressed.

In the past a tool has been provided for lifting the board. Usually the tool has comprised a lever mounted on a base such that when one end of the lever is placed under the board and the other end is pushed down by the foot the board is lifted to the position desired. However, upward pressure must be kept on the lever to hold the board in the proper position until it can be nailed. Usually, two people are required to install the boards since one must keep pressure on the lever while the other nails the board.

It is the purpose of the present invention to provide a jack that can be used not only to lift the board but also to hold the board in the proper position while it is being nailed without further manipulation by the installer.

SUMMARY OF THE INVENTION

A jack for positioning and holding articles, such as wallboard, comprising a base with a pivotally attached lever assembly mounted in a manner such that downward force on one end of the lever assembly will raise the other end, and ratchet means for holding the other end in the raised position until released by actuation of a lever.

DESCRIPTION OF THE DRAWINGS

FIG. 1 is a prospective view of the jack;

FIG. 4 is an enlarged cross sectional view along the line 4—4 of FIG. 3; and FIG. 5 shows the jack in the raised position for elevating a wallboard section.

DESCRIPTION OF A PREFERRED EMBODIMENT

Figure 2:
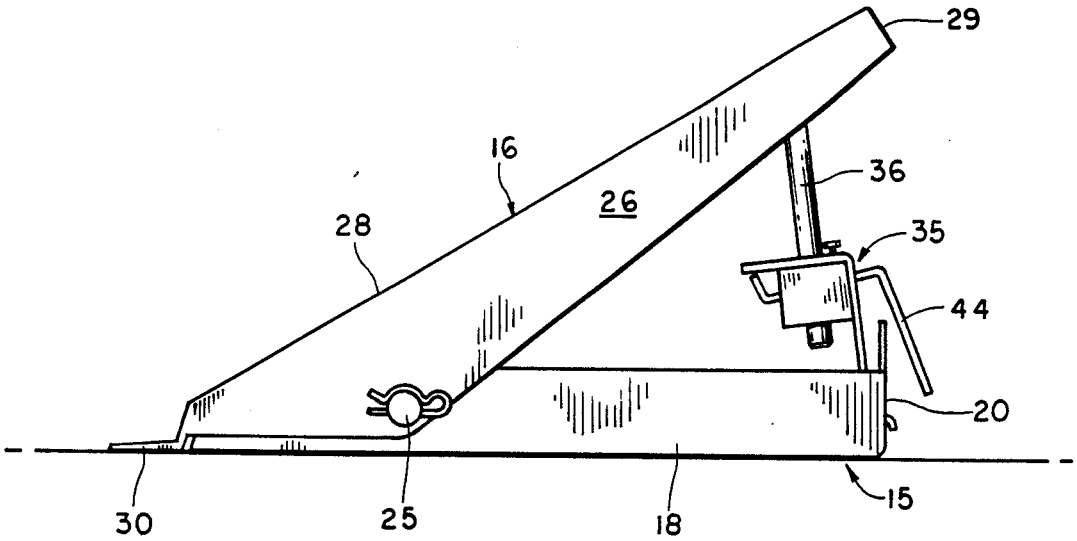
FIG. 2 is a side view of the jack.
Figure 3:
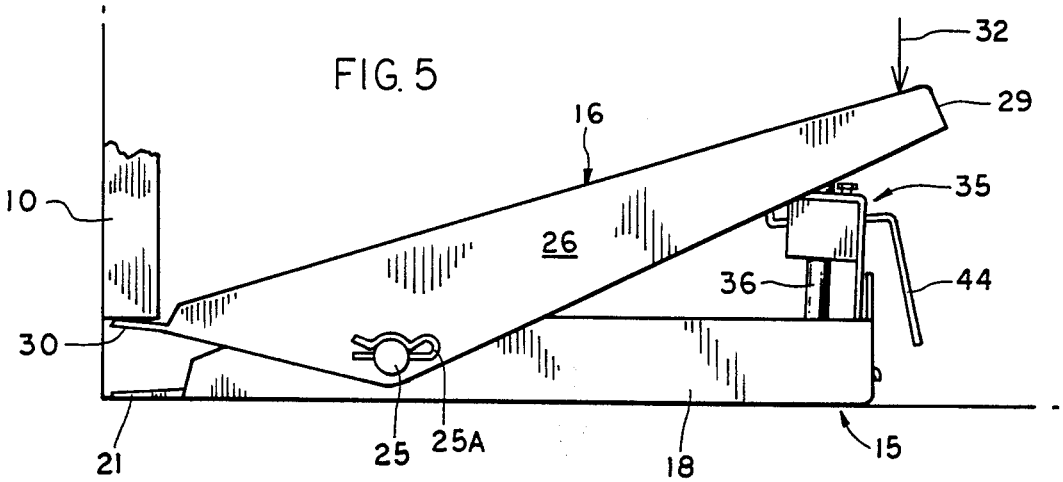
FIG. 3 is an end view of the jack.
Figure 3:
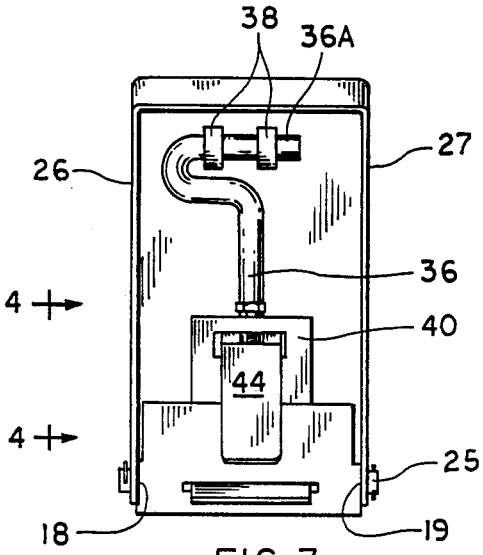

As shown primarily in FIG. 5 the tool is used to raise a wallboard section 10 up above the surface of a floor 11. While there are other uses, this is the primary application. For raising the wallboard there is provided a jack 14 comprising a base 15 and a lever assembly 16. The base comprises a bottom wall 17, side walls 18 and 19, and a back wall 20. The forward end of the base terminates at a planar member 21.

The lever assembly 16 is attached to the base by a pin 25 passing through the side walls 26 and 27 thereof. A key **25*a* locks the pin 25 in position. The base also includes a top wall member 28 and a rear wall member 29 with the front edge terminating in a pair of planar members 30**.

Thus as indicated primarily in FIG. 5, the lever member is moved into a position with the planar members 21 and 30 in interfitting relationship as shown in FIG. 2 and thereafter, by downward pressure indicated by the arrow 32 the planar members 30 are shifted from a lower or first position illustrated in FIG. 2 to an elevated or second position shown in FIG. 5, lifting with them the wallboard 10 as the lever assembly pivots about the pin 25. In this manner the wallboard can be raised to a nailing position with the top edge abutting the ceiling or adjacent wallboard section in the normal manner of installation.

In accordance with the present invention there is provided a ratchet assembly 35 serving as a locking means for holding the lever assembly in the second or elevated position, thereby freeing the installer to move about and nail the wallboard to the wall studs or similar structure. The top of the wallboard is kept in position because it is forced into abutting relationship with either the ceiling or the adjacent wallboard section already nailed in place. For this purpose the ratchet assembly 35 shown primarily in FIGS. 4 and 5 comprises a shaft 36 pivotally attached to the upper wall member 28 of the lever assembly by passage of the end **36*a* thereof through a pair of loops 38 fixed to the bottom side of the top wall member 28. This shaft 36 extends down to the ratchet assembly 35 which comprises a support member 40 held in position by a tab 40*a* passing through an opening 20*a* in the back wall 20 and having an opening 41 therethrough to allow passage of the shaft and an opening 42 to allow passage of a locking member 44. The shaft 36 passes through an opening 45 in the locking lever which lever is biased in the clockwise direction by a spring 46. The shaft also passes through an opening 47 in a bottom wall member 48** to maintain it in an aligned position.

Thus, as the lever assembly is pivoted toward the second or elevated position, the locking lever 44 ratchets along the shaft and holds it in this position. Pressure exerted in the direction of the arrow 49 pivots the locking lever to release it from the shaft 36 and allow the lever assembly to move back to the first or lower position.

If it is not desired that the ratchet assembly 35 function to hold the lever assembly in the elevated position, a screw 50 is provided that is threaded into the support member 40. By tightening down this screw 50 the locking member 44 is disabled and the lever assembly 16 can be moved up and down by the application of pressure with no locking action. Thus the screw 50 serves as means to disable the locking means.

I claim:

1. A jack for positioning and holding wallboard and the like comprising:

a base;

a lever assembly having first and second ends;

means for pivotally mounting the lever assembly on said base so that downward pressure on the first end of said lever assembly will raise the second end thereof;

ratchet means for holding said lever assembly with the second end elevated after pressure is applied to said first end;

releasable locking means actuable for releasing said ratchet means and allowing said second end to pivot downward; and means to disable said locking means to prevent the ratchet from holding said lever assembly with the second end elevated.

* * * * *